US009468252B2

(12) United States Patent
Dimatteo

(10) Patent No.: US 9,468,252 B2
(45) Date of Patent: Oct. 18, 2016

(54) SANDAL WITH PNEUMATIC SUPPORT

(71) Applicant: Vito E. Dimatteo, West Harrison, NY (US)

(72) Inventor: Vito E. Dimatteo, West Harrison, NY (US)

( * ) Notice: Subject to any disclaimer, the term of this patent is extended or adjusted under 35 U.S.C. 154(b) by 240 days.

(21) Appl. No.: 14/493,282

(22) Filed: Sep. 22, 2014

(65) Prior Publication Data

US 2015/0007459 A1 Jan. 8, 2015

Related U.S. Application Data

(63) Continuation-in-part of application No. 13/211,050, filed on Aug. 16, 2011, now Pat. No. 8,869,431.

(60) Provisional application No. 61/376,089, filed on Aug. 23, 2010.

(51) Int. Cl.

| | |
|---|---|
| ***A43B 13/20*** | (2006.01) |
| ***A43B 3/12*** | (2006.01) |
| ***A43B 3/10*** | (2006.01) |
| ***A43B 7/14*** | (2006.01) |

(52) U.S. Cl.

CPC ..... *A43B 3/128* (2013.01); *A43B 3/108* (2013.01); *A43B 7/142* (2013.01); *A43B 7/143* (2013.01); *A43B 13/203* (2013.01)

(58) Field of Classification Search

CPC ..... A43B 3/108; A43B 3/128; A43B 7/142; A43B 7/1465; A43B 13/20; A43B 13/203; A43B 13/206; A43B 17/03; A43B 17/035

USPC ..... 36/29, 91, 93, 11.5

See application file for complete search history.

(56) References Cited

U.S. PATENT DOCUMENTS

| | | | |
|---|---|---|---|
| 1,605,985 | A | 11/1926 | Rasmussen |
| 2,020,240 | A | 11/1935 | Cochran |
| 2,365,807 | A | 12/1944 | Dialynas |

(Continued)

FOREIGN PATENT DOCUMENTS

| | | |
|---|---|---|
| EP | 503924 | 9/1992 |
| GB | 208455 | 12/1923 |
| WO | WO 2008/130401 | 10/2008 |

OTHER PUBLICATIONS

Website, http://www.orthoticshop.com/moszkito-jungle-bug-black-arch-support-sandal-womens.html, two pages printed from the internet on Mar. 21, 2010.

(Continued)

*Primary Examiner* — Ted Kavanaugh
(74) *Attorney, Agent, or Firm* — Richard C. Litman

(57) ABSTRACT

The sandal with pneumatic support includes an inflatable bladder in the sole, in the area immediately beneath the arch of the foot when the sandal is worn. A manual air pump is provided integrally with the sandal. In one embodiment, the pump is located atop the toe divider of a flip-flop type sandal. In another embodiment, the pump is located in the heel. A pressure relief valve is located along one of the upper straps of the sandal. The arch bladder, air pump, and relief valve communicate pneumatically with one another. The sandal may be devoid of structure extending between the toes when worn, but may include straps passing over and/or around the foot. Other embodiments provide additional air bladders in the straps to better secure the sandal on the foot. The sandal provides greatly improved support and reduces or eliminates muscular problems resulting from the lack of arch support.

20 Claims, 8 Drawing Sheets

(56) References Cited

U.S. PATENT DOCUMENTS

| | | | | |
|---|---|---|---|---|
| 2,600,957 | A | 6/1952 | Bartis | |
| 2,791,844 | A | 5/1957 | Horlacher | |
| 2,932,911 | A | 4/1960 | Musebeck et al. | |
| 2,981,010 | A | 4/1961 | Aaskov | |
| 3,121,430 | A | 2/1964 | O'Reilly | |
| 4,106,222 | A | 8/1978 | Houck | |
| 4,166,329 | A | 9/1979 | Herbig | |
| 5,025,575 | A | 6/1991 | Lakic | |
| 5,257,470 | A | 11/1993 | Auger et al. | |
| 5,832,630 | A | 11/1998 | Potter | |
| 6,014,823 | A | 1/2000 | Lakic | |
| 6,120,473 | A | 9/2000 | Oliverio | |
| 6,195,914 | B1 | 3/2001 | Otis | |
| D448,549 | S | 10/2001 | Duclos | |
| 6,550,160 | B2 | 4/2003 | Miller, II | |
| 6,782,640 | B2 | 8/2004 | Westin | |
| 6,848,200 | B1 | 2/2005 | Westin | |
| 6,966,131 | B2 | 11/2005 | McCracken et al. | |
| 6,976,321 | B1 | 12/2005 | Lakic | |
| 7,337,560 | B2 | 3/2008 | Marvin et al. | |
| 7,451,555 | B1 | 11/2008 | Lakic | |
| 8,172,778 | B2 | 5/2012 | Sim et al. | |
| 8,869,431 | B2 * | 10/2014 | Dimatteo | A43B 3/128 36/11.5 |
| 2003/0084593 | A1 | 5/2003 | Lakic | |
| 2004/0003514 | A1 | 1/2004 | Cole | |
| 2005/0022423 | A1 | 2/2005 | Lakic | |
| 2005/0075189 | A1 | 4/2005 | Kaneko | |
| 2007/0068038 | A1 | 3/2007 | McClellan | |
| 2008/0040948 | A1 | 2/2008 | Park | |
| 2009/0019728 | A1 | 1/2009 | Roth | |
| 2012/0042537 | A1 * | 2/2012 | Dimatteo | A43B 3/128 36/11.5 |
| 2013/0283640 | A1 * | 10/2013 | Elder | A43B 3/108 36/102 |

OTHER PUBLICATIONS

Website, http://www.inflasole.com/, Inflasole Adjustable Comfort Insoles, two pages printed from the internet on Mar. 29, 2010.

* cited by examiner

SANDAL WITH PNEUMATIC SUPPORT

CROSS-REFERENCE TO RELATED APPLICATION

This application is a continuation-in-part of U.S. patent application Ser. No. 13/211,050, filed on Aug. 16, 2011, which claimed the benefit of U.S. Provisional Patent Application Ser. No. 61/376,089, filed on Aug. 23, 2010.

BACKGROUND OF THE INVENTION

1. Field of the Invention

The present invention relates generally to footwear, and more particularly to an open shoe or sandal having a pneumatically inflatable arch support and/or other components.

2. Description of the Related Art

The development of at least primitive footwear (sandals, moccasins, etc.) occurred very early in human history due to the need to protect the foot from injury during the typical hunting, gathering, and nomadic existence of early humankind. This early footwear amounted to little more than a means of securing a sheet of protective material beneath the sole of the foot, and thus provided no additional arch or other support. However, people had acclimated to such lack of support due to their normal barefoot custom, and thus the lack of arch support was not critical in such early footwear.

Eventually, shoes and other footwear developed to provide greater protection and comfort for the foot, with thicker soles to prevent penetration by foreign objects, arch support, softer and more comfortable lining, etc., being developed. In addition to the above, stylistic considerations have resulted in shoes and other footwear evolving in myriad different configurations. Shoes or at least some form of footwear is expected, and in most instances required, in virtually all areas of the civilized world in the present day.

Accordingly, nearly everyone becomes accustomed to wearing shoes from their earliest years. Such shoes nearly universally provide the wearer with at least reasonably good arch support, and other benefits as well. As a result, the foot becomes accustomed to such support, and the tendon and muscle structure of the foot may lose much of its supportive ability and strength. This may not be of any great consequence so long as shoes providing the proper support are worn, but such is not always the case.

An example of this occurs when people who are used to wearing supportive shoes, begin to wear sandals during warmer weather. An extreme example is the type of sandal originally known by the Japanese term "zori" but which has become perhaps better known in the vernacular as the "flip-flop," i.e., an inexpensive sandal having a forwardly disposed toe divider that is worn between the big toe and second toe, with left and right side straps extending over the foot and rearward to the edges of the sole. The soles of such flip-flop footwear are universally flat and provide no arch support whatsoever, as is the case with most open (sandal) footwear.

As a result, people who habitually wear such inexpensive footwear during most of the day for months at a time during the warm season may experience various problems due to the lack of arch support provided by such footwear. The lack of proper arch support often results in subconscious adjustments to the posture, with the muscular structure of the legs, hips, and lower back being unaccustomed to such changes. This can result in various muscle aches and pains, strained tendons, plantar fasciitis, and other physical problems to the feet, legs, hips, and lower back, with the problems requiring costly and time-consuming treatment to rectify.

Thus, a sandal with pneumatic support solving the aforementioned problems is desired.

SUMMARY OF THE INVENTION

The sandal with pneumatic support is a sandal having a substantially flat sole and an upper structure securing the sandal to the foot. The sole includes a pneumatically inflatable bladder in the area of the arch of the foot. A small, manually actuated air pump is provided in another area of the sandal. In one embodiment, comprising a flip-flop type sandal, the air pump is located at the top of the toe divider at its juncture with the left and right straps. In another flip-flop sandal embodiment, the air pump is located in the heel. A pressure relief valve is also provided, preferably along one of the upper straps. The pneumatic arch support bladder, inflation pump, and relief valve all communicate with one another pneumatically through suitable passages. The pneumatically inflatable arch support may be applied to any practicable type of sandal, including sandals devoid of a toe divider but having a plurality of straps passing over and around the foot to secure the sandal thereto.

In yet another embodiment, additional air bladders are placed within the straps that extend from the top of the toe divider over the foot. These air bladders distend the straps to increase their thickness, thereby reducing the space between the straps and the sole to provide a better grip for increased security of the sandal on the foot. The strap bladders preferably communicate with the single air pump at the top of the toe divider and with the relief valve and sole bladder to simplify construction and reduce the number of components.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The sandal with pneumatic support is a sandal having a wearer-adjustable pneumatic arch support therein. The sandal with pneumatic support is primarily directed to zori or "flip-flop" type sandals, i.e., sandals having a toe divider between the big toe and second toe when worn, and two straps extending outwardly and rearwardly from the top of the toe divider that are attached to the opposite edges of the sole. However, the adjustable pneumatic arch support may be adapted to virtually any type of sandal or other open shoe.

Figure 1:
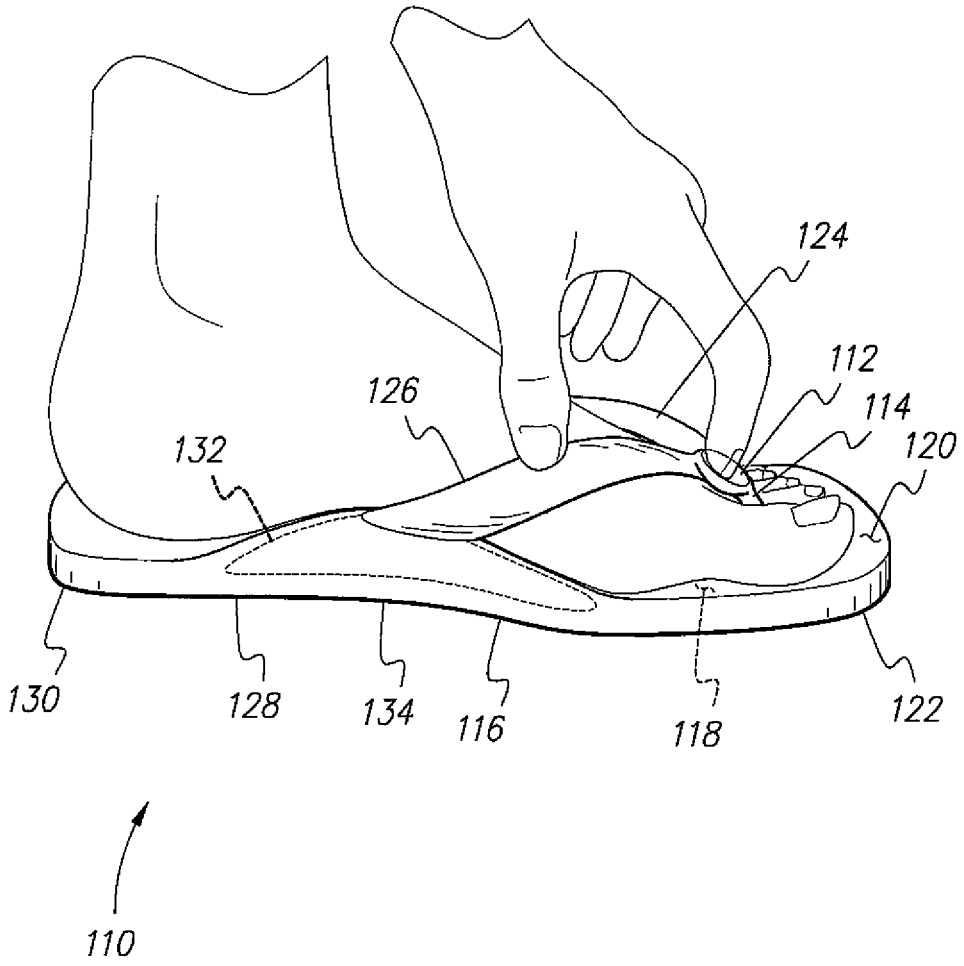
FIG. 1 is an environmental, perspective view of a first embodiment of a sandal with pneumatic support according to the present invention, illustrating its operation.
Figure 2:
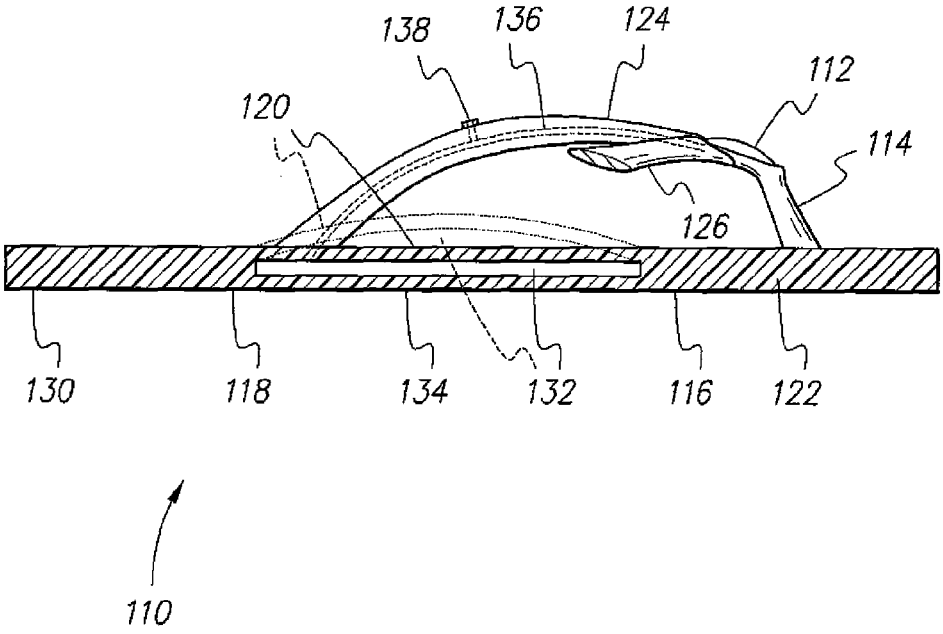
FIG. 2 is a right side view in section of the sandal of FIG. 1, one of the sandal straps being broken away and in section to illustrate further details thereof.

FIGS. 1 and 2 of the drawings illustrate a first embodiment of a sandal with pneumatic support, designated generally as 110 in the drawings, which is a flip-flop sandal having a small, manually actuated air pump 112 permanently affixed atop the toe divider 114 of the sandal, and integrally formed therewith. The flat sole 116 is devoid of supportive contour for the foot, other than the pneumatic arch support. The sole 116 has a lower surface 118, an upper surface 120 parallel thereto, and a core 122 therebetween, and may be formed of leather, foam or other resilient plastic material, or other suitable material. Opposite first and second foot-securing straps 124 and 126 extend from the top of the toe divider 114 rearward to opposite points along the rearward periphery 128 of the sole 116 near the heel portion 130 thereof.

The sole 116 includes a pneumatically inflatable bladder 132 disposed within the core 122 between the upper and lower surfaces 118 and 120, in the arch portion 134 of the sole 116. The bladder 132 is shown in its distended state in broken lines in FIGS. 1 and 2, as it would appear when inflated. The bladder 132 communicates pneumatically with the air pump 112 by means of an elongate air passage 136, shown in broken lines in FIG. 2, that extends through the first strap 124 of the sandal 110. Only one such air passage 136 is required. The second strap 126 may be of solid core construction, as shown in the broken away portion illustrated in FIG. 2.

The sandal 110 operates by the user or wearer of the sandal actuating the air pump 112 (by pressing a button or portion of the pump 112 accessible through an opening at the junction of the straps 124, 126) to inflate the pneumatic bladder 132 to the desired height and firmness. Air is pumped from the pump 112 to the bladder 132 through the air passage 136 of the first strap 124 to adjust the inflation of the bladder 132 for the desired degree of support and comfort. A relief valve 138 is located along the first strap 124. The relief valve communicates pneumatically with the air passage 136 that extends through the first strap 124. The relief valve 138 may be located elsewhere on the sandal 110, so long as the valve 138 communicates pneumatically with the bladder 132. In the event that the user or wearer of the sandal 110 wishes to lower the height of the arch area 134, he or she need only open the relief valve 138 to relieve air pressure within the bladder 132 through the air passage 136 in the strap 124, and thence to the relief valve 138. The resilient nature of the materials used in the construction of the sole 116 result in the bladder 132 deflating to lower the arch area 134 as pressure is relieved within the bladder 132.

Figure 3:
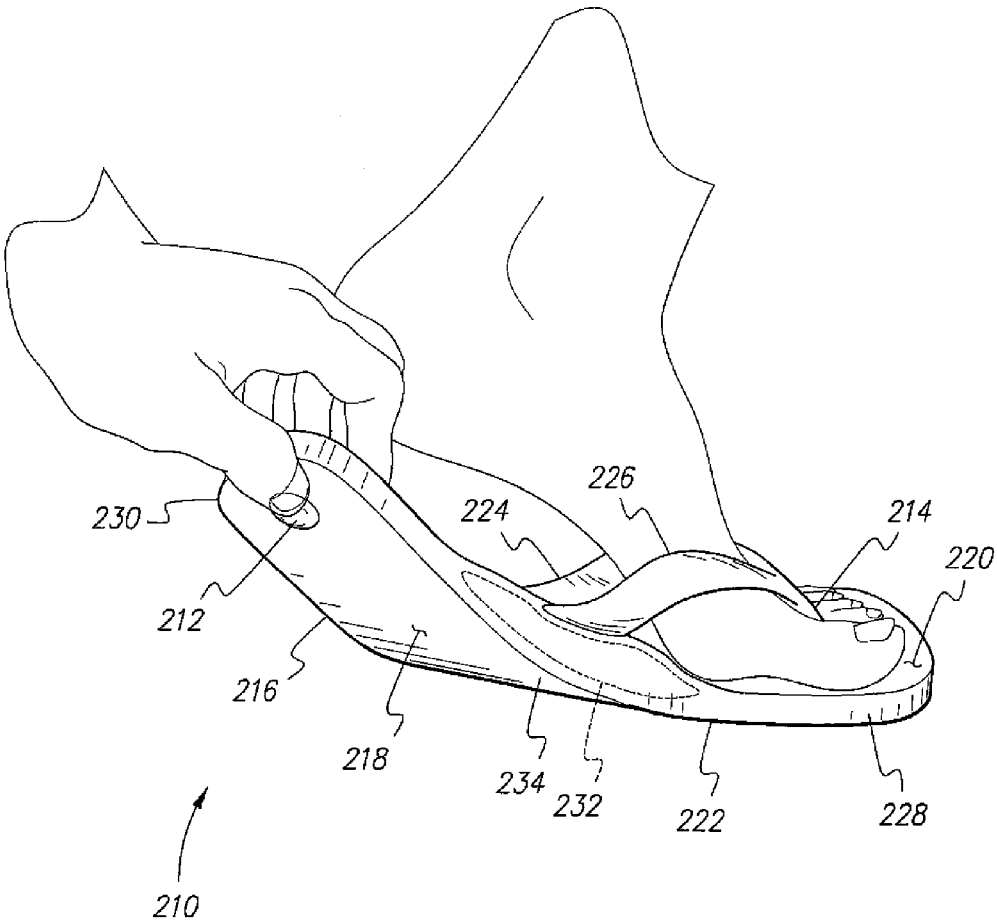
FIG. 3 is an environmental, perspective view of a second embodiment of a sandal with pneumatic support according to the present invention, illustrating its operation.
Figure 4:
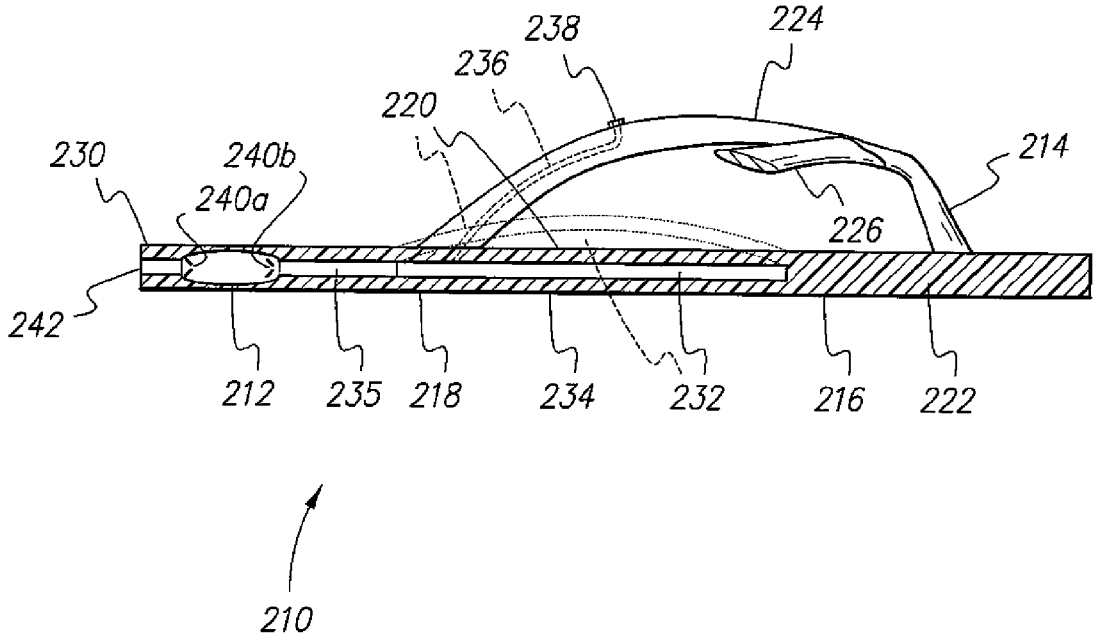
FIG. 4 is a right side view in section of the sandal of FIG. 3, one of the sandal straps being broken away and in section to illustrate further details thereof

FIGS. 3 and 4 illustrate a second embodiment of a zori or flip-flop type sandal, designated as sandal 210. The sandal 210 is quite similar to the sandal 110 of FIGS. 1 and 2, discussed in detail above, but the air pump 212 has been relocated to an area within the heel portion 230 of the sole 216 where it is contained integrally therein as a permanent component. Otherwise, the sandal 210 is much like the sandal 110 of FIGS. 1 and 2. The sole 216 has a lower surface 218, an upper surface 220 parallel thereto, and a core 222 therebetween. The sole 216 is formed of leather, foam or other resilient plastic material, or other suitable material. Opposite first and second foot-securing straps 224 and 226 extend from the top of the toe divider 214 rearward to opposite points along the rearward periphery 228 of the sole 216 near the heel portion 230 thereof.

The sole 216 includes a pneumatically inflatable bladder 232 disposed within the core 222 between the upper and lower surfaces 218 and 220, in the arch portion 234 of the sole 216. The bladder 232 is shown in its distended state in broken lines in FIGS. 3 and 4, as it would appear when inflated. The bladder 232 communicates pneumatically with the air pump 212 in the heel 230 by means of an air passage 235, shown in the cross-sectional view of FIG. 4, that extends from the pump 212 chamber to the rearward portion or end of the pneumatic bladder 232. FIG. 4 also provides a cross-sectional view of the air pump 212, showing its internal configuration. The air pump 212 includes one-way inlet and outlet check valves 240*a* and 240*b* (e.g., conventional duckbill valves, flapper valves, etc.) that prevent air from passing back through the pump and back through the pump inlet 242.

The sandal 210 with its pneumatic arch support operates in essentially the same manner as described further above for the operation of the sandal 110 of FIGS. 1 and 2, i.e., by actuating the air pump 212 (by pressing a button or portion of the pump accessible through an opening in the lower surface 218 of the sole 216) to inflate the pneumatic bladder 232 to the desired height and firmness. Air is pumped from the pump 212 to the bladder 232 through the air passage 235 within the sole 216 to adjust the inflation of the bladder 232 as desired. A relief valve 238 is located along the first strap 224. The relief valve communicates pneumatically with the air passage 236 that extends through the first strap 224. The opposite second strap 226 is solid, as in the case of the second strap 126 of the sandal 110 of FIGS. 1 and 2. The relief valve 238 is formed of a resilient material, as in the case of other materials used in the construction of the sandal.

The relief valve may comprise a conventional button or the like that may be pushed in or pulled out to open the valve and returned to its original position to seat or close the valve. Such low-pressure valves are conventional and well known in the art. The pressure relief valve 238 may be located elsewhere on the sandal 210, so long as the valve 238 communicates pneumatically with the bladder 232. In the event that the user or wearer of the sandal 210 wishes to lower the height of the arch area 234, he or she need only open the relief valve 238 to relieve air pressure within the bladder 232 through the air passage 236 within the strap 224 to the relief valve 238. The resilient nature of the materials used in the construction of the sole 216 result in the bladder 232 deflating to lower the arch area 234 as pressure is relieved within the bladder 232.

Figure 5:
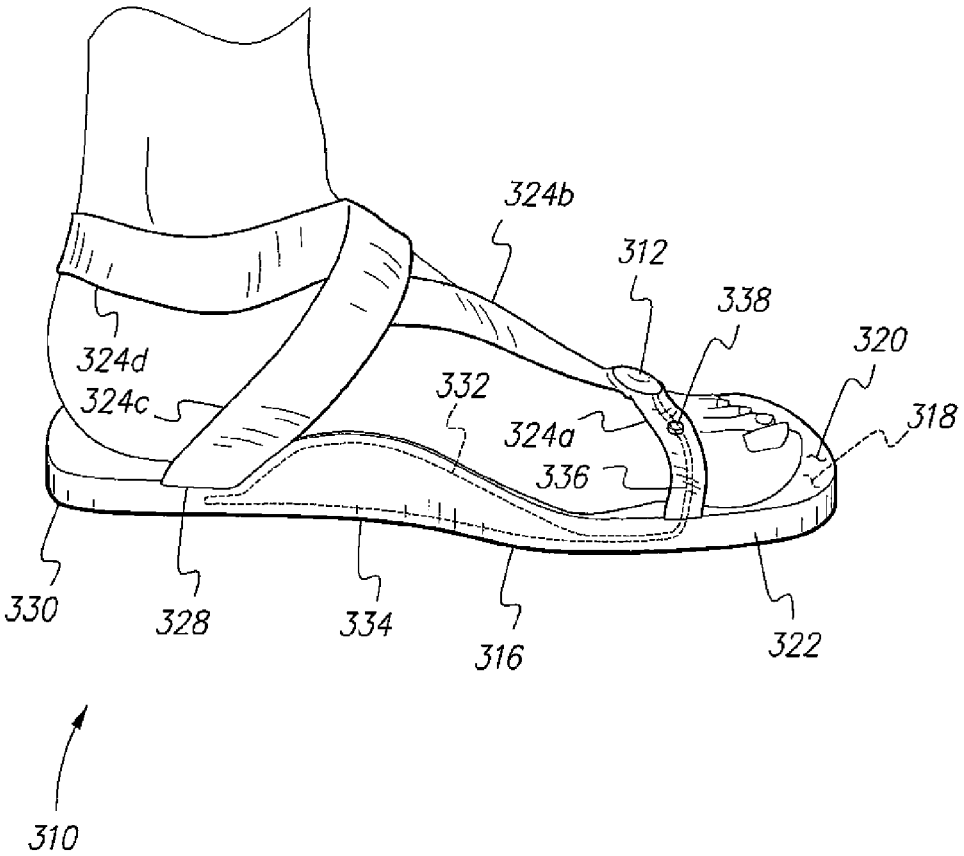
FIG. 5 is an environmental, perspective view of a third embodiment of a sandal with pneumatic support according to the present invention.

FIG. 5 provides an environmental perspective view of another alternative embodiment of a sandal with pneumatic support, designated as sandal 310. The construction of the lower portion of the sandal 310 is much like that of the sandals 110 and 210 described further above, i.e., having a flat sole 316 essentially devoid of supportive contour for the foot, other than the pneumatic arch support. The sole 316 has a lower surface 318, an upper surface 320 parallel thereto, and a core 322 therebetween formed of leather, foam or other resilient plastic material, or other suitable material. Rather than having the "flip-flop" sandal configuration of the embodiments of FIGS. 1 through 4, the sandal 310 of FIG.

5 has a multiple strap configuration, comprising a forward lateral strap 324*a* and an upper strap 324*b* extending rearward to the juncture of a diagonal rear strap 324*c* and an ankle strap 324*d*. The straps 324*a* and 324*c* are connected to the sole 316 along or near the periphery 328 thereof near the forward end and heel portion 330. The straps are preferably formed of leather, plastic, or some other suitable resilient material.

The sole 316 includes a pneumatically inflatable bladder 332 disposed within the core 322 between the upper and lower surfaces 318 and 320, in the arch portion 334 of the sole. The bladder 332 is shown in its distended state in broken lines in FIG. 5, as it would appear when inflated. In the sandal embodiment 310 of FIG. 5 the small, manually actuated air pump 312 used to inflate the bladder 332 is permanently and integrally disposed atop the juncture of the forward lateral strap 324*a* and the upper strap 324*b*. The air pump 312 is structured much the same as the air pump 212 illustrated in section in FIG. 4 for the sandal 210. However, it will be seen that the pump 312 may be located elsewhere on the sandal, so long as it communicates pneumatically with the air bladder 332.

In the example illustrated in FIG. 5, the bladder 332 communicates pneumatically with the air pump 312 by means of an elongate air passage 336, shown in broken lines in FIG. 5, that extends through the forward lateral strap 324*a* of the sandal 310 from the air pump 312 to the forward end of the bladder 332. Only one such air passage 136 is required, and the other straps 324*b*, 324*c*, and 324*d* are of solid core construction.

The sandal 310 operates in essentially the same manner as described further above for the operation of the sandal 110 of FIGS. 1 and 2 and the sandal 210 of FIGS. 3 and 4, i.e., by actuating the air pump 312 (by pressing a button or a portion of the pump accessible at the junction of the forward lateral strap 324*a* and the upper strap 324*b*) to inflate the pneumatic bladder 332 to the desired height and firmness. Air is pumped from the pump 312 to the bladder 332 through the air passage 336 within the forward lateral strap 324*a* to adjust the inflation of the bladder 332.

A relief valve 338 is located along the forward lateral strap 324*a*. The relief valve communicates pneumatically with the air passage 336 that extends through the forward lateral strap 324*a*. The relief valve 338 is preferably essentially identical to the relief valves 138 and 238 of the sandal embodiments 110 and 210, i.e., comprising a conventional button or the like that may be pushed in or pulled out to open the valve and returned to its original position to seat or close the valve. Such low-pressure valves are conventional and well known in the art. The pressure relief valve 338 may be located elsewhere on the sandal 310, so long as the valve 338 communicates pneumatically with the bladder 332. In the event that the user or wearer of the sandal 310 wishes to lower the height of the arch area 334, he or she need only open the relief valve 338 to relieve air pressure within the bladder 332 through the air passage 336 through the strap 324*a* to the relief valve 338. The resilient nature of the materials used in the construction of the sole 316 result in the bladder 332 deflating to lower the arch area 334 as pressure is relieved within the bladder 332.

Figure 6:
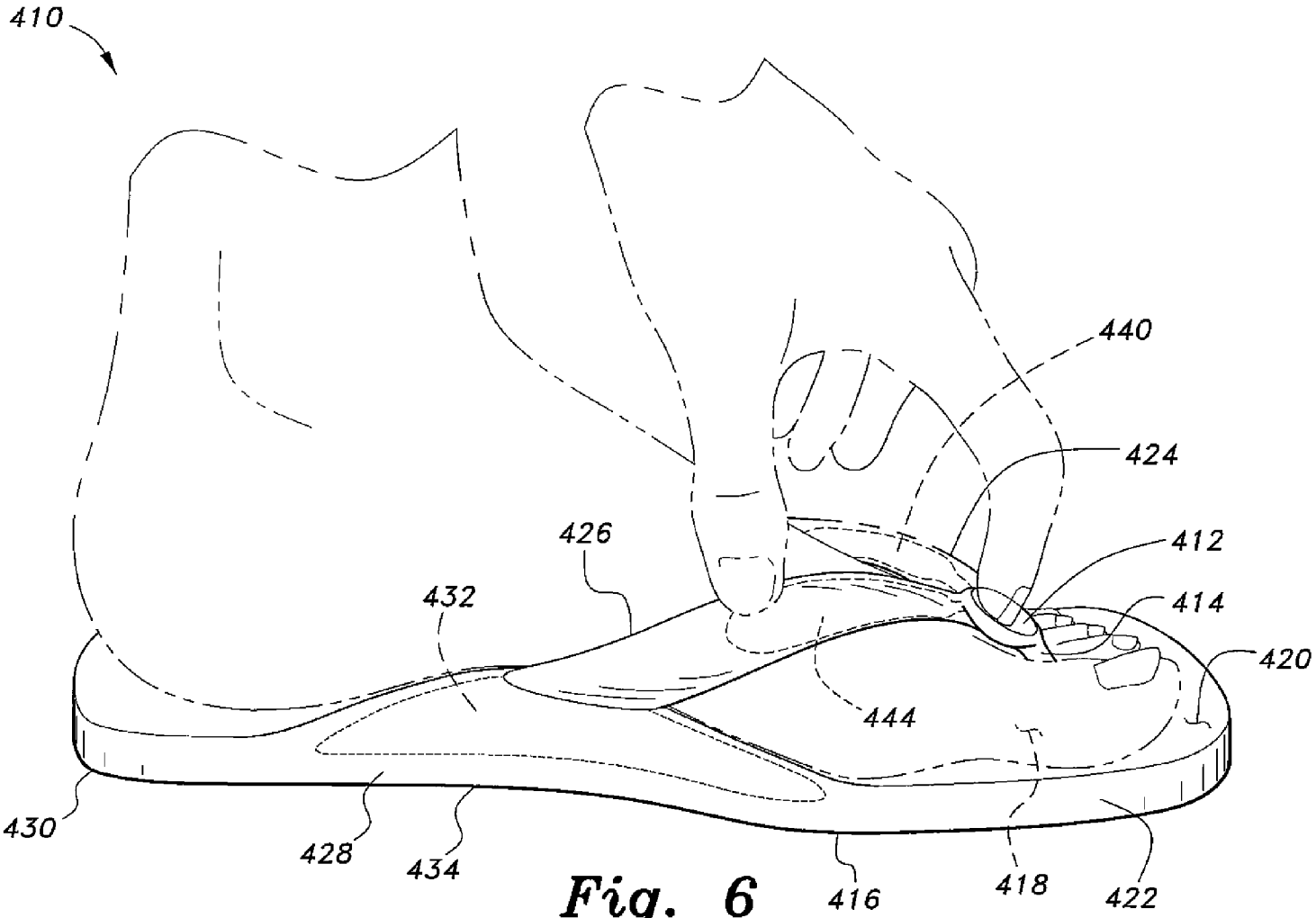
FIG. 6 is an environmental, perspective view of a fourth embodiment of a sandal with pneumatic support according to the present invention, illustrating its operation.
Figure 7:
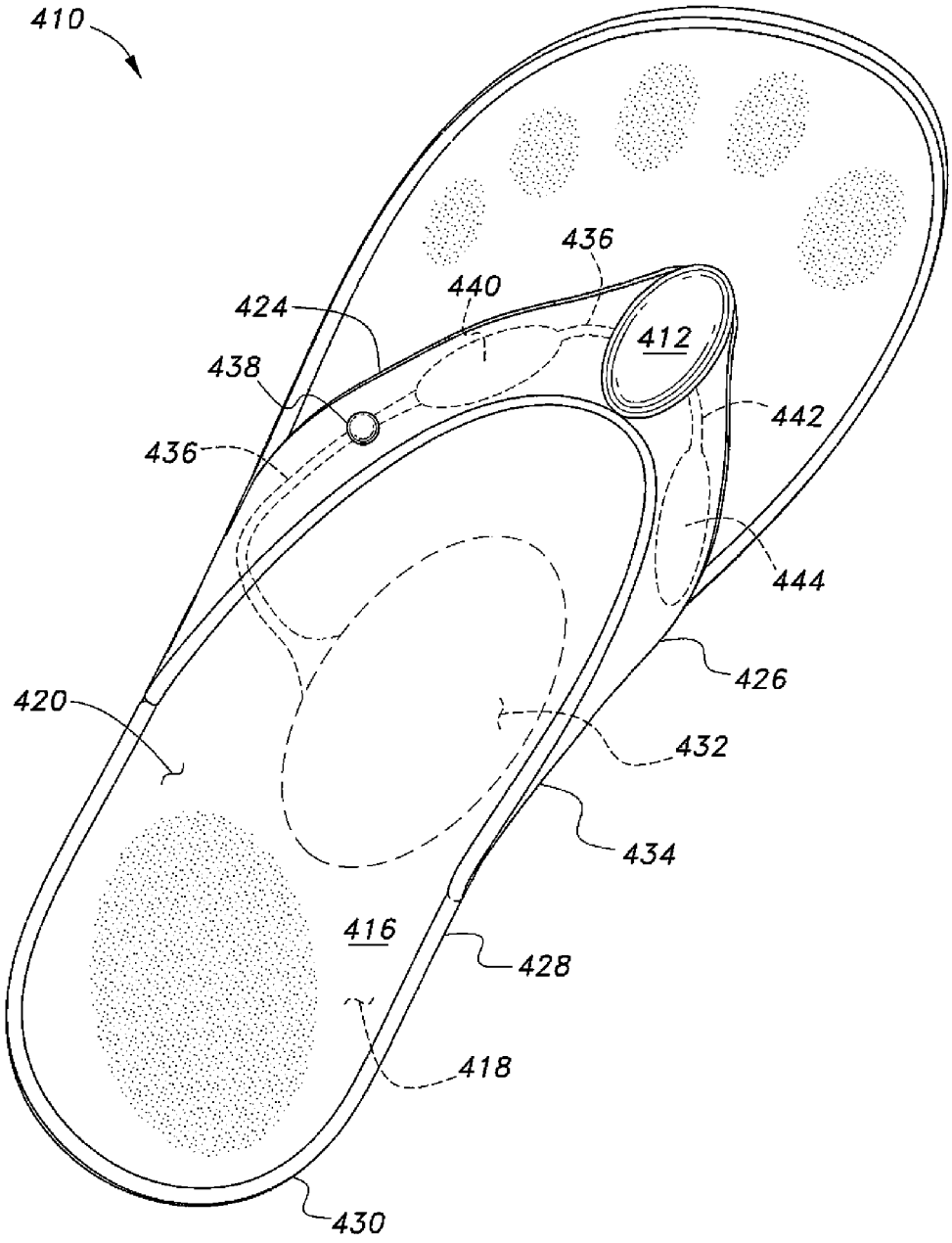
FIG. 7 is a top plan view of the sandal with pneumatic support of FIG. 6, illustrating further details thereof.
Figure 8:
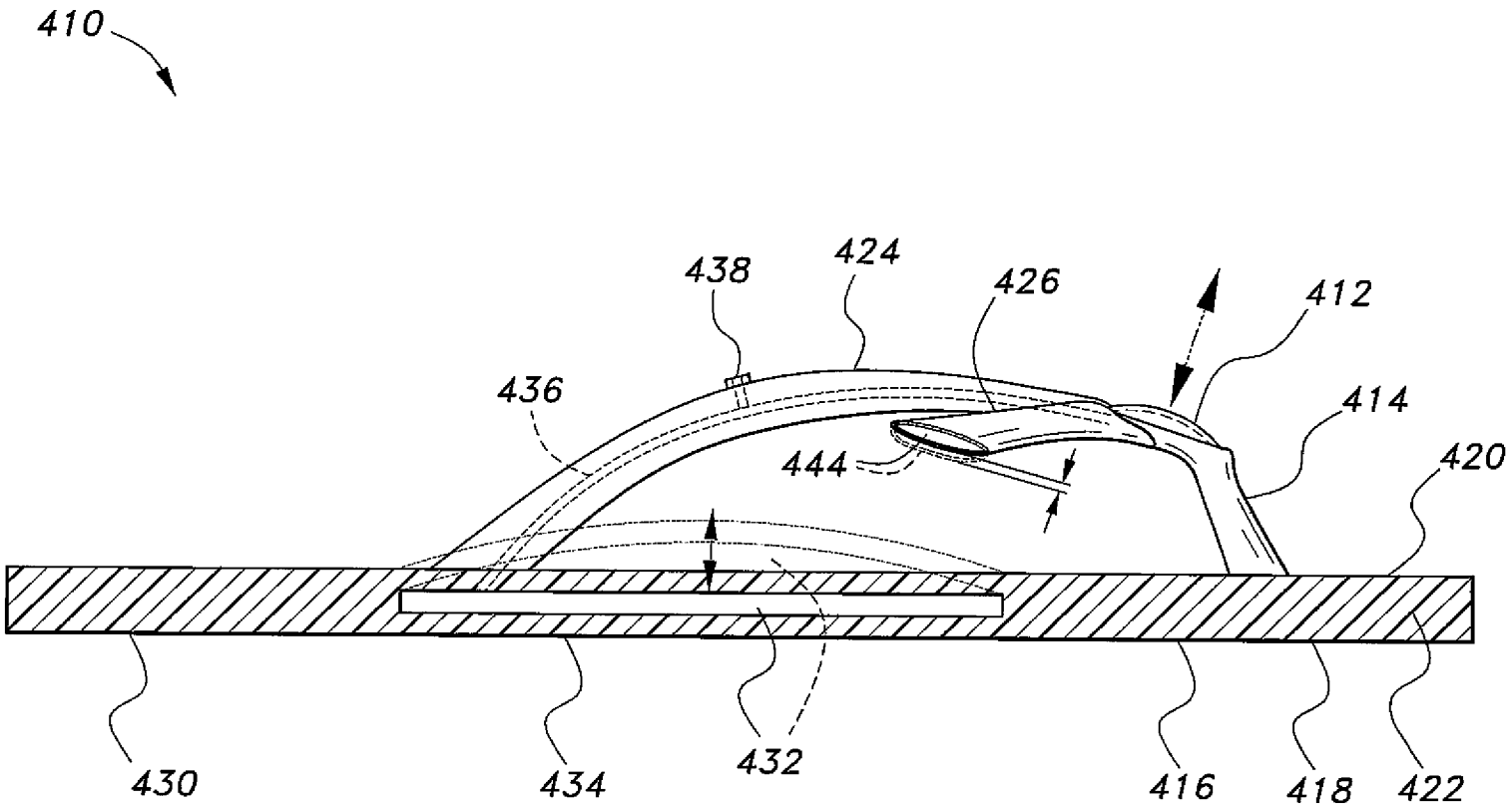
FIG. 8 is a side elevation view in section of the sandal with pneumatic support of FIG. 6, illustrating further details thereof.

FIGS. 6 through 8 of the drawings illustrate a fourth embodiment of a sandal with pneumatic support, designated generally as 410 in the drawings, which is a flip-flop sandal having a small, manually actuated air pump 412 permanently affixed atop the toe divider 414 of the sandal, and integrally formed therewith. The flat sole 416 is devoid of supportive contour for the foot, other than the pneumatic arch support. The sole 416 has a lower surface 418, an upper surface 420 parallel thereto, and a core 422 therebetween, and may be formed of leather, foam or other resilient plastic material, or other suitable material. Opposite first and second foot-securing straps 424 and 426 extend from the top of the toe divider 414 rearward to opposite points along the rearward periphery 428 of the sole 416 near the heel portion 430 thereof.

The sole 416 includes a pneumatically inflatable sole bladder 432 disposed within the core 422 between the upper and lower surfaces 418 and 420, in the arch portion 434 of the sole. The bladder 432 located in the sole 416 is shown in its distended state in broken lines in FIGS. 6 and 8, as it would appear when inflated. The arch bladder 432 communicates pneumatically with the air pump 412 by means of an elongate first strap air passage 436, shown in broken lines in FIGS. 7 and 8, that extends through the first strap 424 of the sandal 410.

The first strap 424 further includes a selectively distensible first strap air bladder 440 disposed therein, in series with the first strap air passage 436. The second strap 426 includes a second strap air passage 442 (FIG. 7), similar to the portion of the air passage 436 that extends between the air pump 412 and the first strap air bladder 440. The second strap air passage 442 communicates pneumatically with a second strap air bladder 444 disposed within the second strap 426. There is no air passage extension from the second strap bladder 444 to the bladder 432 in the sole 416, as the bladder 432 communicates pneumatically with the air pump 412 via the first strap air passage 336. In other words, the air pump 412 selectively supplies air through the first strap air passage 436 to the first strap air bladder 440 and thence to the bladder 432 in the sole 416 through the extended air passage 436 from the first strap air bladder 440 to the arch bladder 432. Simultaneously with the above, the air pump 412 supplies air through the second strap air passage 442 to the second strap air bladder 444. No additional air passage extends from the second strap air bladder 444 due to the first strap air passage extension 436 between the first strap air bladder 440 and the bladder 432 in the sole 416.

The two strap air bladders 440 and 444 are located relatively low within their respective straps 424 and 426, i.e., the lower or bottom wall of each strap 424, 426 is relatively thin and resilient in order to distend more toward the sole 416 (or against the top of a foot when the sandal 410 is being worn) when the bladders 440 and 444 are inflated. This results in the two straps 424, 426 exerting somewhat greater pressure upon the top of the foot when the bladders 440 and 444 are inflated, as indicated by the distended second strap bladder 444, shown in broken lines in FIG. 8. This additional pressure, along with the lifting of the arch portion 434 of the upper surface 420 of the sole 416 due to inflation of the bladder 432 in the sole 416, tends to hold the sandal 410 more securely on the foot when the sandal 410 is being worn, while still providing a comfortable fit.

The sandal 410 operates in the same manner as that described further above for the first sandal embodiment 110 of FIGS. 1 and 2, i.e., by the user or wearer of the sandal actuating the air pump 412 (by pressing a button or portion of the pump 412 accessible through an opening at the junction of the straps 424, 426) to inflate the pneumatic bladder 432 in the sole 416 to the desired height and firmness and the two straps 424, 425 to the desired thickness by means of the two strap bladders 440 and 444. Air is pumped from the pump 412 to the first strap bladder 440 and thence to the bladder 432 in the sole 416 through the air passage 436 of the first strap 424 to adjust the inflation of the strap bladder 440 and arch bladder 432 for the desired degree of support and comfort. Air is also supplied simultaneously to the second strap bladder 440 by the second strap air passage 442, to adjust the thickness of the second strap 426.

A relief valve 438 is located along the first strap 424. The relief valve communicates pneumatically with the air passage 436 that extends through the first strap 424. The relief valve 438 may be located elsewhere on the sandal 410, so long as the valve 438 communicates pneumatically with the bladders 432, 440, and 444. In the event that the user or wearer of the sandal 410 wishes to lower the height of the arch area 434 and pressure from the straps 424 and 426, he or she need only open the relief valve 438 to relieve air pressure within the bladders 432, 440, and 444 through the air passage 436 in the first strap 424 and air passage 444 in the second strap 426 (through the air pump 412), and thence to the relief valve 438. The resilient nature of the materials used in the construction of the sole 416 and the two straps 424, 426 result in the respective bladders 432, 440, and 444 deflating to lower the arch area 434 and reduce the distension of the two straps 424, 426 as pressure is relieved within the bladders 432, 440, and 444.

The sandal with pneumatic support, in any of its various embodiments, permits the wearer of the sandal to adjust the height and support provided by the arch portion of the sole to suit his or her individual needs and foot structure. While only left sandals are illustrated in the drawings, it will be noted that the illustrated structures may be applied equally to right sandals as well. The individually adjustable arch areas of the soles of such sandals permit the wearer of the sandals to adjust each arch support area individually as required. If one foot requires less arch support than the other, the wearer may apply a lower supporting pressure to the bladder of that sandal, as required. Moreover, the embodiment of FIGS. 6 through 8 provides greater security of the sandal on the foot as the two strap bladders are inflated along with the sole bladder. It will be seen that although the embodiment of FIGS. 6 through 8 describes the air pump as being located atop the toe divider, the embodiment of FIGS. 3 and 4 may be provided with strap air bladders as well by providing air passages from the sole bladder extending partially through the two straps to strap bladders disposed therein. The embodiment of FIG. 5 may incorporate such strap bladders as well. Accordingly, the sandal with pneumatic support will prove to be a valuable article of footwear for many people who enjoy wearing such open footwear when the opportunity arises.

It is to be understood that the present invention is not limited to the embodiments described above, but encompasses any and all embodiments within the scope of the following claims.

I claim:

1. A sandal with pneumatic support, comprising:

a generally flat sole having an upper surface, a lower surface, a core extending between the upper surface and lower surface, an arch area, a heel portion, and a periphery;

a toe divider extending upwardly from the upper surface of the sole;

a plurality of foot-securing straps extending from the periphery of the sole, at least one of the straps having an air passage and a pneumatically distensible strap bladder disposed therein;

a pneumatically distensible second bladder disposed within the arch area of the sole;

a manually actuated air pump communicating pneumatically with each of the bladders, the air pump being permanently and integrally connected to each of the bladders; and a pressure relief valve communicating pneumatically with each of the bladders, each of the bladders, the air pump, and the pressure relief valve communicating pneumatically with one another by means of the air passage in the at least one of the straps.

2. The sandal with pneumatic support according to claim 1, wherein:

said plurality of foot-securing straps comprises a first foot-securing strap and a second foot-securing strap, each of the foot-securing straps extending from the toe divider to the periphery of the sole, the first foot-securing strap having the air passage disposed therethrough and the strap bladder disposed therein, the second foot-securing strap being solid;

said air pump is installed atop the toe divider and permanently and integrally disposed therewith, said air pump communicating pneumatically with each of the bladders through the air passage of the first foot-securing strap; and said pressure relief valve is disposed along the first foot-securing strap, the pressure relief valve communicating pneumatically with each of the bladders and with said air pump through the air passage of the first foot-securing strap.

3. The sandal with pneumatic support according to claim 1, wherein:

said plurality of foot-securing straps comprises a first foot-securing strap and a second foot-securing strap, each of the foot-securing straps extending from the toe divider to the periphery of the sole, the first foot-securing strap having the air passage disposed therethrough and the strap bladder disposed therein, the second foot-securing strap being solid;

said air pump is installed in the heel portion of the sole and permanently and integrally disposed therewith, said air pump communicating pneumatically with each of the bladders; and said pressure relief valve is disposed along the first foot-securing strap, the pressure relief valve communicating pneumatically with each of the bladders and with said air pump through the air passage of the first foot-securing strap.

4. The sandal with pneumatic support according to claim 1, wherein said plurality of foot-securing straps comprises a first foot-securing strap and a second foot-securing strap, each foot-securing strap having an air passage disposed therethrough and a strap bladder disposed therein.

5. The sandal with pneumatic support according to claim 1, wherein the air pump comprises a resilient chamber having an inlet and an outlet, the chamber further including a first one-way check valve adjacent the inlet and a second one-way check valve adjacent the outlet.

6. The sandal with pneumatic support according to claim 1, wherein the relief valve comprises a resilient, selectively openable closure.

7. The sandal with pneumatic support according to claim 1, wherein the sole and the foot-securing straps are formed of resilient plastic material.

8. The sandal with pneumatic support according to claim 1, wherein the sole and the foot-securing straps are formed of leather.

9. A sandal with pneumatic support, comprising:

a generally flat sole having an upper surface, a lower surface, a core extending between the upper surface and lower surface, an arch area, a heel portion, and a periphery;

a toe divider extending upwardly from the upper surface of the sole;

a first foot-securing strap and a second foot-securing strap, each of the foot-securing straps extending from the toe divider to the periphery of the sole, the first foot-securing strap having an air passage disposed therethrough and a pneumatically distensible strap bladder disposed therein;

a pneumatically distensible arch bladder disposed within the arch area of the core of the sole;

a manually actuated air pump disposed atop the toe divider and permanently and integrally disposed therewith, the air pump communicating pneumatically with each of the bladders through the air passage in the first foot-securing strap; and a pressure relief valve disposed along the first foot-securing strap, the pressure relief valve communicating pneumatically with each of the bladders through the air passage in the first foot-securing strap.

10. The sandal with pneumatic support according to claim 9, further comprising a second air passage disposed through the second foot-securing strap and a second strap bladder disposed in the second foot-securing strap, the second air passage and the second strap bladder communicating pneumatically with said air pump, the air passage and the strap bladder in said first foot-securing strap, said pressure relief valve, and said arch bladder.

11. The sandal with pneumatic support according to claim 9, wherein the air pump comprises a resilient chamber having an inlet and an outlet, the chamber further including a first one-way check valve adjacent the inlet and a second one-way check valve adjacent the outlet.

12. The sandal with pneumatic support according to claim 9, wherein the relief valve comprises a resilient, selectively openable closure.

13. The sandal with pneumatic support according to claim 9, wherein the sole and the foot-securing straps are formed of resilient plastic material.

14. The sandal with pneumatic support according to claim 9, wherein the sole and the foot-securing straps are formed of leather.

15. A sandal with pneumatic support, comprising:

a generally flat sole having an upper surface, a lower surface, a core extending between the upper surface and lower surface, an arch area, a heel portion, and a periphery;

a toe divider extending upwardly from the upper surface of the sole;

a first foot-securing strap and a second foot-securing strap, each of the foot-securing straps extending from the toe divider to the periphery of the sole, the first foot-securing strap having an air passage disposed therethrough and a pneumatically distensible strap bladder disposed therein;

a pneumatically distensible arch bladder disposed within the arch area of the core of the sole;

a manually actuated air pump disposed in the heel portion of the sole and permanently and integrally disposed therewith, the air pump communicating pneumatically with the arch bladder; and a pressure relief valve disposed along the first foot-securing strap, the pressure relief valve communicating pneumatically with each of the bladders through the air passage in the first foot-securing strap.

16. The sandal with pneumatic support according to claim 15, further comprising a second air passage disposed through the second foot-securing strap and a second strap bladder disposed in the second foot-securing strap, the second air passage and the second strap bladder communicating pneumatically with said air pump, the air passage and the strap bladder in said first foot-securing strap, said pressure relief valve, and said arch bladder.

17. The sandal with pneumatic support according to claim 15, wherein the air pump comprises a resilient chamber having an inlet and an outlet, the chamber further including a first one-way check valve adjacent the inlet and a second one-way check valve adjacent the outlet.

18. The sandal with pneumatic support according to claim 15, wherein the relief valve comprises a resilient, selectively openable closure.

19. The sandal with pneumatic support according to claim 15, wherein the sole and the foot-securing straps are formed of resilient plastic material.

20. The sandal with pneumatic support according to claim 15, wherein the sole and the foot-securing straps are formed of leather.

* * * * *